US009173253B2

(12) United States Patent
Wohl et al.

(10) Patent No.: US 9,173,253 B2
(45) Date of Patent: Oct. 27, 2015

(54) IONIC ADDER DRYER TECHNOLOGY

(75) Inventors: Michael Andrew Wohl, Talbott, TN (US); David S. Wisherd, Carmel, CA (US); John A. Eisenberg, Los Altos, CA (US); Pablo E. D'Anna, Redding, CA (US)

(73) Assignee: Cool Dry, Inc., San Jose, CA (US)

( * ) Notice: Subject to any disclaimer, the term of this patent is extended or adjusted under 35 U.S.C. 154(b) by 823 days.

(21) Appl. No.: 13/297,282

(22) Filed: Nov. 16, 2011

(65) Prior Publication Data

US 2013/0119055 A1 May 16, 2013

(51) Int. Cl.

| | |
|---|---|
| ***H05B 6/64*** | (2006.01) |
| ***F26B 3/34*** | (2006.01) |
| ***H05B 6/62*** | (2006.01) |
| ***H05B 6/50*** | (2006.01) |

(52) U.S. Cl.

CPC ... *H05B 6/62* (2013.01); *H05B 6/50* (2013.01)

(58) Field of Classification Search

CPC ..... F26B 3/34; H05B 6/64

USPC ..... 219/400, 771, 629–632, 643, 678–688, 219/690–697, 702, 704, 708–716; 34/528, 34/245–247, 250–265

See application file for complete search history.

(56) References Cited

U.S. PATENT DOCUMENTS

| | | | | |
|---|---|---|---|---|
| 2,472,193 A | | 6/1949 | Clayton | |
| 2,511,839 A | | 6/1950 | Frye | |
| 3,605,272 A | | 9/1971 | Boucher | |
| 3,854,219 A | | 12/1974 | Staats | |
| 3,866,255 A | | 2/1975 | Serota | |
| 3,938,260 A | | 2/1976 | Brenner et al. | |
| 4,000,340 A | * | 12/1976 | Murphy et al. | 428/34.1 |
| 4,126,563 A | | 11/1978 | Barker | |
| 4,250,628 A | | 2/1981 | Smith et al. | |
| 4,334,136 A | * | 6/1982 | Mahan et al. | 219/681 |
| 4,356,640 A | | 11/1982 | Jansson | |
| 4,490,923 A | * | 1/1985 | Thomas | 34/260 |
| 5,463,821 A | | 11/1995 | Gauer | |

(Continued)

FOREIGN PATENT DOCUMENTS

| | | |
|---|---|---|
| EP | 0 862 218 A1 | 9/1998 |
| EP | 1 753 265 A1 | 2/2007 |

(Continued)

OTHER PUBLICATIONS

U.S. Appl. No. 12/803,089: Office Action dated Oct. 25, 2013 by Examiner John P. McCormack.

(Continued)

*Primary Examiner* — David Angwin
*Assistant Examiner* — Michael LaFlame, Jr.
(74) *Attorney, Agent, or Firm* — Edward J. Radlo; Radlo IP Law Group

(57) ABSTRACT

A method for RF dielectric heating an object having a variable weight including a medium is provided The method comprises: (A) placing the object having the variable weight including the medium into an enclosure; (B) adding an ionic substance to the medium; (C) initiating a heating process by subjecting the medium including the object to a variable AC electrical field; and (D) controlling the heating process. The method further comprises using an air flow having an ambient temperature, or being heated before getting into the enclosure, to carry away the evaporated medium from the enclosure.

2 Claims, 3 Drawing Sheets

(56) References Cited

U.S. PATENT DOCUMENTS

| | | | | |
|---|---|---|---|---|
| 5,712,469 | A | 1/1998 | Chaffin et al. | |
| 5,869,817 | A | 2/1999 | Zietlow et al. | |
| 5,983,520 | A | 11/1999 | Kim et al. | |
| 6,124,624 | A | 9/2000 | Van Roosmalen et al. | |
| 6,141,634 | A | 10/2000 | Flint et al. | |
| 6,344,638 | B1 | 2/2002 | Tomasello | |
| 6,417,499 | B2 | 7/2002 | Blaker et al. | |
| 6,423,955 | B1 | 7/2002 | Blaker et al. | |
| 6,657,173 | B2 | 12/2003 | Flugstad et al. | |
| 6,825,618 | B2 | 11/2004 | Pu et al. | |
| 6,914,226 | B2 | 7/2005 | Ottaway | |
| 6,971,189 | B1 | 12/2005 | Anibas | |
| 7,034,266 | B1 | 4/2006 | DeGroot et al. | |
| 7,325,330 | B2 | 2/2008 | Kim et al. | |
| 7,380,423 | B1 | 6/2008 | Musone | |
| 7,933,733 | B2 | 4/2011 | Ashrafzadeh et al. | |
| 8,035,255 | B2 | 10/2011 | Kurs et al. | |
| 8,058,588 | B2 | 11/2011 | Gagas et al. | |
| 8,215,133 | B2 | 7/2012 | Kim et al. | |
| 8,405,467 | B2 | 3/2013 | He | |
| 8,826,561 | B2 | 9/2014 | Wisherd et al. | |
| 8,943,705 | B2 | 2/2015 | Wisherd et al. | |
| 2002/0047009 | A1 | 4/2002 | Flugstad et al. | |
| 2003/0224965 | A1* | 12/2003 | Conley et al. | 512/1 |
| 2004/0031731 | A1 | 2/2004 | Honeycutt et al. | |
| 2004/0261286 | A1 | 12/2004 | Green et al. | |
| 2006/0109327 | A1 | 5/2006 | Diamond et al. | |
| 2007/0045307 | A1* | 3/2007 | Tsui et al. | 219/775 |
| 2007/0085689 | A1* | 4/2007 | Brommer et al. | 340/572.8 |
| 2007/0163144 | A1 | 7/2007 | Dittmer et al. | |
| 2007/0251118 | A1* | 11/2007 | Doh | 34/528 |
| 2007/0271814 | A1 | 11/2007 | Bae et al. | |
| 2008/0307667 | A1* | 12/2008 | Ikemizu | 34/132 |
| 2009/0236334 | A1 | 9/2009 | Ben-Shmuel et al. | |
| 2009/0255145 | A1* | 10/2009 | Poy | 34/480 |
| 2009/0272004 | A1 | 11/2009 | Chernetski et al. | |
| 2010/0115708 | A1* | 5/2010 | Caswell et al. | 8/137 |
| 2010/0115785 | A1* | 5/2010 | Ben-Shmuel et al. | 34/260 |
| 2010/0236088 | A1 | 9/2010 | Paice | |
| 2011/0067186 | A1 | 3/2011 | Johansson | |
| 2011/0146102 | A1 | 6/2011 | Bellinetto et al. | |
| 2012/0096737 | A1 | 4/2012 | Kmet et al. | |
| 2012/0125909 | A1 | 5/2012 | Scheunert et al. | |

FOREIGN PATENT DOCUMENTS

| | | | |
|---|---|---|---|
| GB | 835454 | A | 5/1960 |
| WO | WO 97/32071 | A1 * | 9/1997 |
| WO | 03/019985 | A1 | 3/2003 |

OTHER PUBLICATIONS

U.S. Appl. No. 12/957,401: Office Action dated Oct. 25, 2013 by Examiner John P. McCormack.

Wilson et al., Radio-Frequency Dielectric Heating in Industry, Thermo Energy Corporation, Report [online], Mar. 1987 (Mar. 1987). Retrieved from Internet: <URL: http://infohouse.p2ric.org/ref/39/38699.pdf.

U.S. Appl. No. 12/803,089, Office Action dated Mar. 7, 2013 by Examiner John P. McCormack.

International Search Report (ISA/US) mailed Sep. 15, 2011 for international patent application PCT/US2011/038594 filed May 31, 2011, 3 pages.

Written Opinion of the International Searching Authority (ISA/US) mailed Sep. 15, 2011 for international patent application PCT/US2011/038594 filed May 31, 2011, 15 pages.

International Search Report (ISA/US) mailed Aug. 3, 2012 for international patent application PCT/US2012/033900 filed Apr. 17, 2012, 4 pages.

Written Opinion of the international Searching Authority (ISA/US) mailed Aug. 3, 2012 for international patent application PCT/US2012/033900 filed Apr. 17, 2012, 6 pages.

International Search Report (ISA/US) mailed Jan. 25, 2013 for international patent application PCT/US2012/061736 filed Oct. 24, 2012, 3 pages.

Written Opinion of the International Searching Authority (ISA/US) mailed Jan. 25, 2013 for international patent application PCT/US2012/061736 filed Oct. 24, 2012, 5 pages.

Specification sheet for 1 KW Class E Module PRF-1150 power module © 2002, Directed Energy, Inc., downloaded on Mar. 17, 2014 from: http://ixys.com/SearchResults.aspx?search=class+E&SearchSubmit=Go, 17 pages.

* cited by examiner

IONIC ADDER DRYER TECHNOLOGY

TECHNICAL FIELD

The technology relates to the field of Radio Frequency (RF) heating systems.

BACKGROUND

Conventional clothes dryers heat a large volume of air that then passes over tumbling clothes. Water is extracted from the wet clothes by evaporation into the heated air. This conventional drying process is extremely inefficient, as at least 50% of the energy consumed by the machine goes out the vent.

The stated above inefficiency of conventional drying process is due to the fact that air is a very poor heat conductor. Thus, for example, only very small engines can be air cooled efficiently. On the other hand, some large engines, for example, an automobile engine, or a high power motorcycle engine, use water cooling because water is much better heat conductor than air.

SUMMARY

This Summary is provided to introduce a selection of concepts that are further described below in the Detailed Description. This Summary is not intended to identify key or essential features of the claimed subject matter, nor is it intended to be used as an aid in determining the scope of the claimed subject matter.

A method for RF dielectric heating an object having a variable weight including a medium is proposed.

The method comprises: (A) placing the object having the variable weight including the medium into an enclosure; (B) adding an ionic substance to the medium; (C) initiating a heating process by subjecting the medium including the object having to a variable AC electrical field; and (D) controlling the heating process.

The object has substantially absorbed medium in a first "cool" state and therefore includes a maximum weight in the first "cool" state due to absorption of medium.

The object is substantially free from medium in a second "heated" state due to substantial release of medium from the object, wherein the released medium is evaporated during the heating process. The heating process is completed when the object is substantially transitioned into the second "heated" state.

The method further comprises using an air flow having an ambient temperature, or being heated before getting into the enclosure, to carry away the evaporated medium from the enclosure.

DESCRIPTION OF THE DRAWINGS

The accompanying drawings, which are incorporated in and form a part of this specification, illustrate embodiments of the technology and, together with the description, serve to explain the principles below.

DETAILED DESCRIPTION

Figure 1:
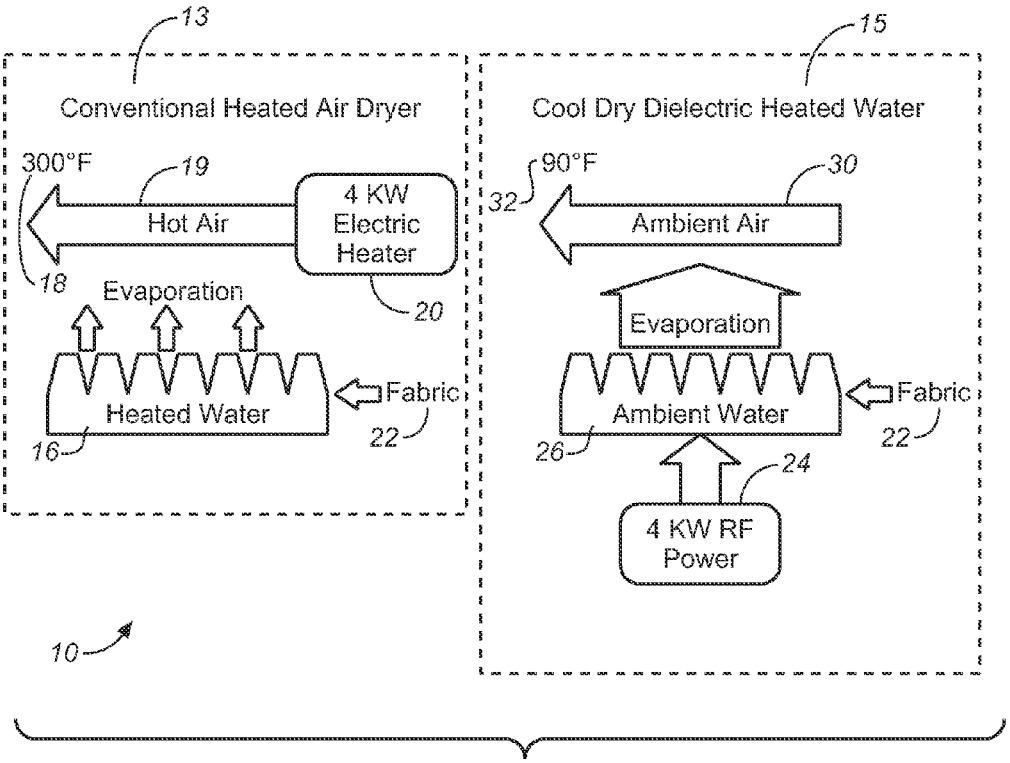
FIG. 1 illustrates comparison between the conventional heated air dryer and a Cool Dry ionic adder dryer for the purposes of the present technology.

Reference now is made in detail to the embodiments of the technology, examples of which are illustrated in the accompanying drawings. While the present technology will be described in conjunction with the various embodiments, it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following detailed description, numerous specific-details are set forth in order to provide a thorough understanding of the presented embodiments. However, it will be obvious to one of ordinary skill in the art that the presented embodiments may be practiced without these specific details. In other instances, well known methods, procedures, components, and circuits have not been described in detail as not to unnecessarily obscure aspects of the presented embodiments.

In the embodiment of the present technology, an ionic adder process is employed that introduces a small amount of an ionic substance into the load to increase the heating efficiency of an RF dielectric heating moisture polar liquid removal system and to simplify the RF matching circuitry. Thus, the ionic adder process lowers the cost of tuner circuitry and improves the efficiency of the drying process by optimizing the matching. In addition, the ionic adder process also reduces harmful emissions into the air.

In the embodiment of the present technology, the new ionic adder process is applied to the dryer developed and described in the U.S. patent application Ser. No. 13/112,880 "DIELECTRIC DRYER DRUM" that is assigned to the assignee of the present patent application. The U.S. patent application Ser. No. 13/112,880 is hereafter referred to as the patent application #1. The patent application #1 is incorporated by reference in its entirety in the current patent application.

The patent application #1 discloses a method for heating an object having a variable weight that includes a medium. The method comprises: (A) placing the object having the variable weight including medium into an enclosure; (B) initiating a heating process by subjecting medium including the object having the variable weight to a variable AC electrical field; and (C) controlling the heating process.

The patent application #1 discloses the cylindrical drum having a cathode plate that includes at least one impellor utilized to introduce the RF power. An air flow is used to efficiently carry out the evaporated water off the system.

The patent application #1 further discloses the technique employed for controlling an air flow rate to facilitate removal of evaporated water from the drum.

The patent application #1 further discloses an air path controlled by selecting an element design (from the group consisting of: an intake air duct design (not shown), an air chamber design (not shown), and a drum impellor design (see discussion below). The element design is configured to facilitate removal of evaporated water from the drum.

Thus, in the patent application #1 the RF energy is essentially introduced into the chamber in a novel way thus allowing maintaining the size and volume of the chamber constant, without moving parts inside.

The patent application #1 further discloses that the impellors of the dielectric dryer drum have a double function: to scramble the clothes for better exposure to the air that removes the moisture, and also to provide the RF anode connection.

The patent application #1 further discloses that the impellors of the dryer drum are used as anodes for connection to the load with variable materials (including fabrics), weight and moisture.

The patent application #1 further discloses that the load effective shape and volume is varied by the drum rotation speed & direction, drum shape and impellor design to optimize energy transfer from the RF power source to the load over the drying cycle.

FIG. 1 illustrates the comparison diagram 10 between the conventional heated air dryer 13 and the proprietary Cool Dry dielectric dryer 15 disclosed in the patent application #1.

As disclosed in the patent application #1 and as shown in FIG. 1, in the conventional heated air dryer, the 4 kW applied power 20 causes heating of the hot air 19 up to 300° F. 18 due to evaporation of air heated water 16. Such hot temperature adversely affects the properties of the drying fabric 22.

As disclosed in the patent application #1 and as shown in FIG. 1, on the other hand, in the Cool Dry dielectric dryer 15 the 4 kW applied RF power 24 causes evaporation of heated water 26 but does not cause heating of the ambient air 30 that has temperature only up to 90° F. (room temperature) 32. Such ambient temperature does not adversely affect the properties of the drying fabric 22.

Figure 2:
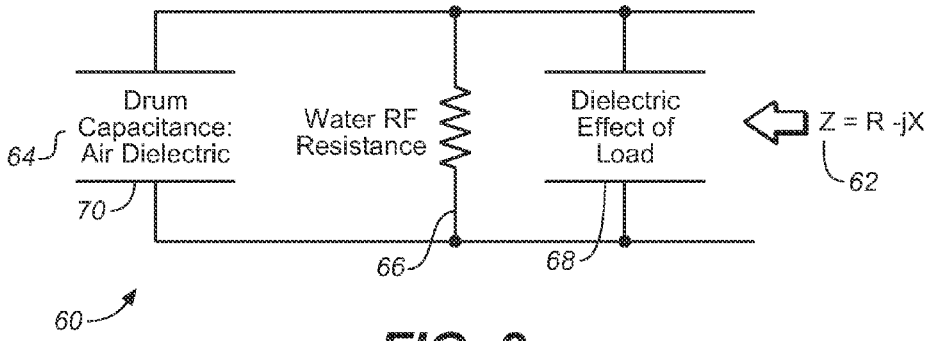
FIG. 2 shows a dielectric load model for the purposes of the present technology.

As disclosed in the patent application #1, FIG. 2 illustrates the dielectric load model 60 of the dielectric dryer drum.

As disclosed in the patent application #1 and as shown in FIG. 2, the drum has a fundamental capacitance, 70 based on its physical dimensions and air dielectric permittivity 64. The laundry load may be thought electrically as a parallel RF impedance consisting of a capacitor representing the dryer physical structure as modified by the laundry load dielectric constant in parallel with a resistor representing the resistivity of the moist laundry load. The water in the load has an RF resistance 66 related to the amount of water contained. The materials in the load add an additional capacitance 68 to the model, based on their dielectric constant>1. Thus, the load impedance 62 is:

$$Z=R-jX \quad \text{(Eq. 1)}$$

The imaginary part (−) jX of the parallel RF impedance Z is simply the capacitive reactance of the capacitance of the dryer physical structure modified by the laundry load dielectric constant measured at the frequency of the RF source.

The real part R of the parallel RF impedance is due to the resistivity of the ionic substance content of the water in the laundry load. All domestic water has some ionic substance content residue.

The problem with this set up is that the RF power source encounters large swings in load resistance values as the drying cycle proceeds, forcing to use a tuning system with a wide tuning range and inefficient coupling into the high resistance load.

In an embodiment of the present technology, by introducing an additional amount of an ionic substance into the load, the overall RF dryer efficiency is improved near the end of the dry cycle where the RF parallel laundry load impedance would be rapidly increasing.

Figure 3:
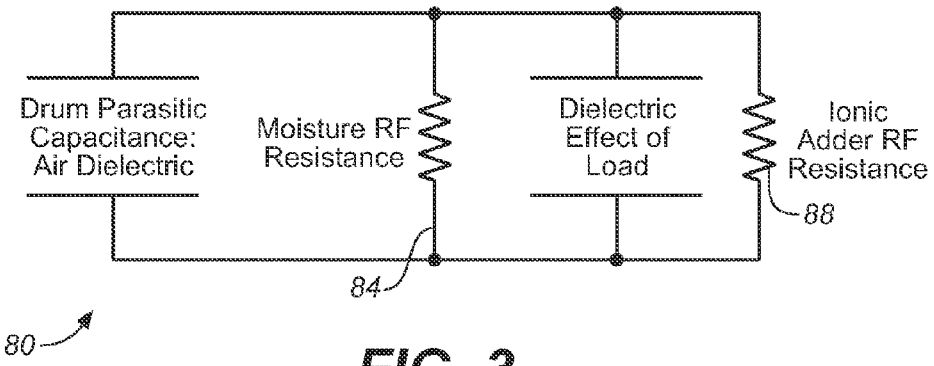
FIG. 3 depicts a dielectric dryer RF load model with Ionic adder substance for the purposes of the present technology.

In an embodiment of the present technology, FIG. 3 depicts a dielectric dryer RF load model 80 with the Ionic adder RF resistance 88 in parallel.

In an embodiment of the present technology, as shown in FIG. 3, during the drying cycle, the moisture RF resistance 84 rises as the load dries. The power is dissipated in both Load Model resistances: the moisture RF resistance 84 and the Ionic adder RF resistance 88.

In an embodiment of the present technology, by adding the Ionic adder RF resistance 88 the overall parallel resistance Rp (of the moisture RF resistance 84 and the Ionic adder RF resistance 88) is reduced. Thus, the energy transfer efficiency from the RF generator to the load is improved because the matching range of the tuner is reduced. An air flow is used to carry away an evaporated medium from the enclosure.

The parallel reactance (−) Xp is not altered by the addition of the ionic substance. In order to transfer maximum energy from the RF power source to the laundry load, the value of (−) Xp should be reduced to zero and the value of Rp should be transformed to the resistance into which the RF Source is configured to deliver maximum power (Rg)

The transformation of Rp→Rg and (−) Xp→0 is accomplished using a RF matching network (or RF tuner 106 of FIG. 4.) including at least two reactive elements. Typically these reactive elements comprise at least one inductor. The RF matching network is placed between the RF power source and the laundry load.

Capacitors used in high power RF matching networks have low losses (Hi Q) and do not dissipate significant RF energy. Inductors on the other hand are lower Q devices and have associated series resistance. RF energy is dissipated in each inductor's series resistance reducing overall dryer efficiency particularly near the end of the dry cycle. The energy dissipated in the RF matching network reduces overall dryer efficiency.

As Rp increases higher currents flow in matching network elements increasing energy dissipated in these elements, particularly the inductors. Reducing Rp by addition of an ionic substance reduces losses in the RF matching network thus increasing dryer efficiency In an embodiment of the present technology, the ionic adder substance is selected from the group consisting of: a solid ionic substance; a liquid ionic substance; and an ionic gaseous substance.

In an embodiment of the present technology, the ionic adder substance is selected from the group consisting of: at least one ionic salt; at least one acid; at least one base; a mixture of at least one ionic salt and at least one acid; a mixture of at least one ionic salt and at least one base; a mixture of at least one acid and at least one base; and a mixture of at least one ionic salt, at least one acid, and at least one base.

In an embodiment of the present technology, the solid ionic adder substance is selected from the group consisting of: sodium chloride; ammonium chloride; and potassium chloride.

In an embodiment of the present technology, the liquid ionic adder substance is selected from the group consisting of: dilute acidic substance of mineral acid; and hydrochloric acid.

In an embodiment of the present technology, the gaseous ionic adder substance is selected from the group consisting of: HCl; NH4OH; and mixture of HCl and NH4OH.

Table I summarizes different ionic adder substances that can be used for the purposes of the present technology:

TABLE I

| — | Solid | Liquid | Gas |
|---|---|---|---|
| salt | NaCl | Sol'n | N/A |
| acid | N/A | $H_2So_4$ | HCl |
| base | NaOH | Sol'n | $NH_4OH$ |

In an embodiment of the present technology, if an Ionic adder substance includes some kind of liquid, as liquid evaporates, the non-evaporating ionic substances remain, increasing ionic molarities in the remaining liquid. This causes the net parallel resistance to increase at a lower rate than the basic, non-ionic adder, thus making the case for more efficient RF power matching. Thus, by adding an ionic substance, one dynamically adjusts the real part of impedance of the object during the drying process, wherein the ionic substance is configured to act as an RF match tuner function by changing the real part of impedance of the object.

In an embodiment of the present technology, the Ionic adder benefits are: (a) better load match at near dry conditions for much better RF energy efficiency transfer from the RF power source; (b) less variation of load resistance over the drying cycle which then requires less RF tuner range.

Figure 4:
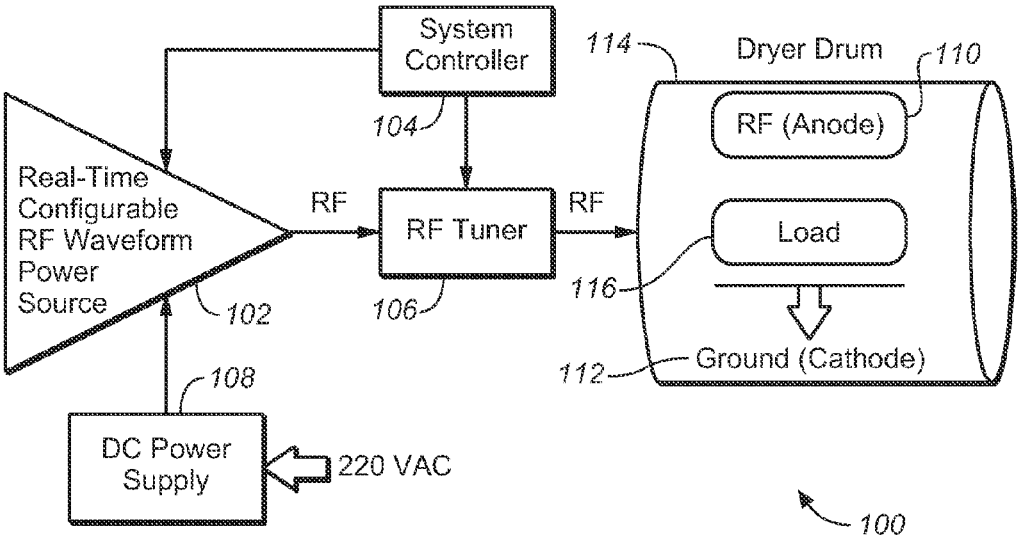
FIG. 4 illustrates RF dryer system, with impedance matching network (RF Tuner) for the purposes of the present technology.

In an embodiment of the present technology, FIG. 4 illustrates RF dryer system 100, with impedance matching network (RF Tuner) 106 including: a dryer drum 114 having RF Anode 110, ground (Cathode) 112, and Load 116; a DC Power supply 108, a real-time configurable RF waveform power source 102; a system controller 104, and a RF tuner 106.

In an embodiment of the present technology, more specifically, the imaginary part of the parallel RF impedance is cancelled or tuned out by the RF Tuner 106 (as shown in FIG. 4) placed between the RF source 102 and the laundry load 116. In an embodiment of the present technology, the RF tuner 106 includes an Electrochemical RF Tuner/Dispenser (not shown).

In an embodiment of the present technology, the impedance matching network, or the Electrochemical RF Tuner/Dispenser, is configured to optimally transfer RF power from the RF source 106 into the real part of the laundry load 116 impedance where it is dissipated generating heat, which vaporizes the water in the laundry load. Thus, the impedance matching network transforms the real part of the laundry load impedance to the output resistance of the RF generator, as was explained above.

In an embodiment of the present technology, the RF tuner 106 is a device that transforms a load impedance Rload+jXload into a purely real generator impedance Rg. The tuner or matching network contains at least two elements (one of which should be an inductor due to the capacitive nature of the load). These could be two inductors, or a capacitor and an inductor. If the magnitude of Rload is either very high or very low compared to Rg, the inductors in the matching network can have significant currents flowing through them. Because practical inductors have associated series resistance, these high currents can dissipate energy in the inductors.

Thus the impedance matching network transforms the laundry load's parallel RF impedance to a matched serial load seen by the RF source. This arrangement yields optimum transfer of RF energy between the RF source and the laundry load.

However; the parallel RF impedance of the load changes as moisture is removed during the drying process; as water is removed, the load capacitance of the dryer physical structure modified by the laundry load dielectric constant remains essentially constant while the real part of the impedance increases. The real part of the parallel RF impedance increases particularly rapidly near the end of the drying cycle. The change in the value of the real part of the parallel load impedance can be as great as sixty to one; this is because when the laundry load is bone dry it is a good insulator. Thus its parallel resistance is quite high.

It is difficult to efficiently transfer energy from the RF source into the nearly dry, high parallel resistance laundry load, and the RF energy is increasingly dissipated in components employed in the impedance matching network as the laundry load approaches dryness due to the finite Q of these elements.

As energy is dissipated in the RF matching network; less RF energy is available to vaporize water in the nearly dry clothes. Components in the matching network become hot. This results in shortening the lifetime of these components. Overall dryer efficiency is degraded in the final minutes of the dry cycle as the last 15%-1% of moisture content is removed from the laundry load.

By reducing the rapid increase of the real part of the parallel load impedance near the end of the dry cycle and by reducing the change in the real part's magnitude to an approximated a 2.5 to 1 spread, heating of matching network components is greatly reduced.

As was explained above, introducing the ionic substance augments the function of the RF impedance matching network. For example, by using the common sodium chloride (salt), the range over which load resistance should be transformed to match the output resistance of the RF generator is greatly reduced. The reduced impedance transformation range decreases the tuning range and heating of the components in the RF impedance matching network.

The ideal solution to the problem described above is to maintain the load impedance constant over the full dry cycle. The process described in the present patent application uses an ionic substance to approximate the ideal constant impedance condition, preventing the rapid increase in the value of the load impedance.

An ionic substance, such as a water solution of sodium chloride (table salt) can be quite conductive. The conductivity of an ionic substance is a function of its concentration and is a weak function of its temperature. As the concentration of the ionic substance increases, its resistivity measured in ohm-cm drops.

If a small amount of an ionic substance were added to the laundry load at the initiation of the dry cycle, its concentration may be chosen to be low enough so that it does not significantly change the already low impedance of the laundry load prior the addition of the substance.

In an embodiment of the present technology, the initial concentration of the ionic substance may be chosen so that the initial total resistance at the beginning of the dry cycle is exactly equal to the total resistance near the end of the cycle. The resistance range without ionic substance adder is typically as great as sixty to one. With the ionic adder it is reduced to less than 2.5:1. This results in a very efficient dryer operation during the entire dry cycle with the reduced tuning range.

The amount of ionic substance required to achieve the required reduction of parallel resistance is very small. Typically a substance of much less than 0.005 g/L concentration is needed. This is 5 mg of the ionic substance dissolved in a liter of water. The mass of ionic adder added is typically $1/500{,}000$ that of the weight of the dry laundry load. This amount of ionic substance cannot be tasted and does not leave any visible residue on dark colored clothing in the laundry load.

Figure 5:
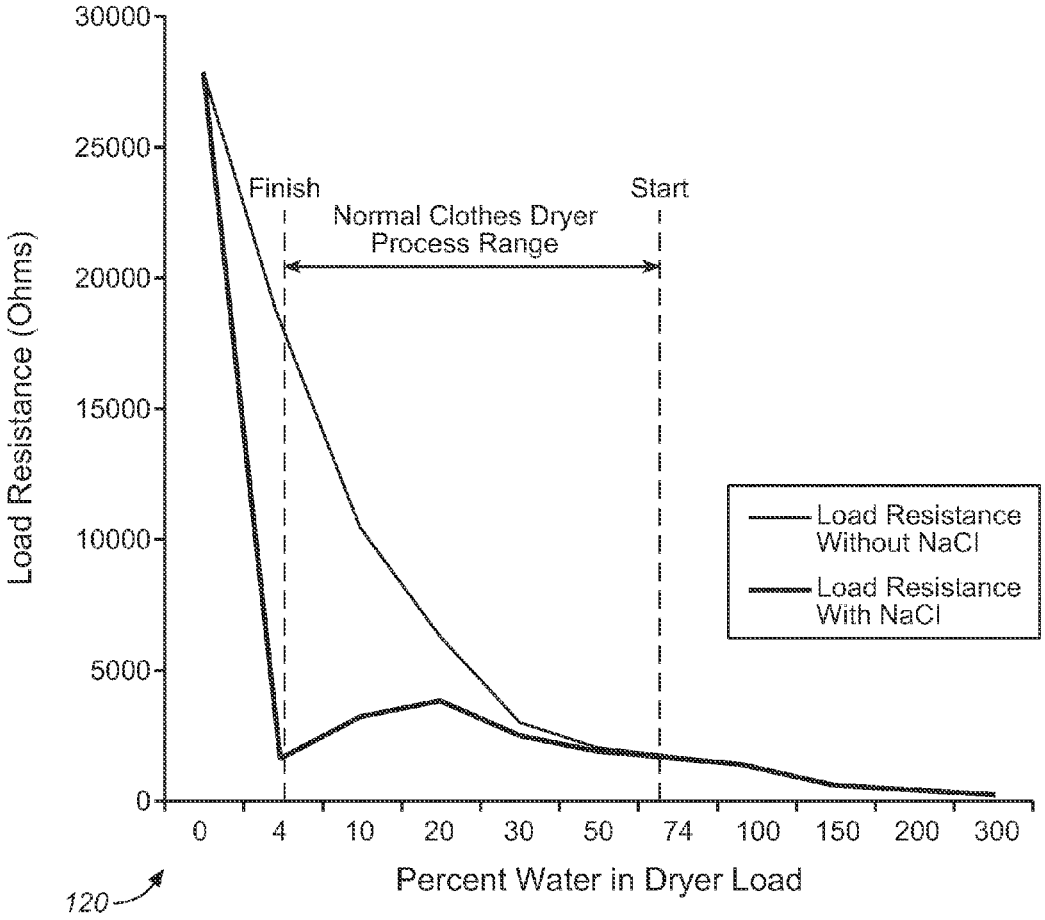
FIG. 5 is a flow chart of parallel load resistance with and without NaCl adder for the purposes of the present technology.

In an embodiment of the present technology, the optimum amount of ionic substance to add may be determined by a simple calculation. Indeed, the optimum amount of ionic substance is that amount that will reduce the real part Rp of the parallel load impedance Zp at 4% moisture content to be the same value as it is at 75% moisture content. The chart 120 of FIG. 5 illustrates Rp with an optimum amount of ionic substance (NaCl) added. Note that the concentration of the ionic substance has increased by nearly a factor of 20 as the moisture content of the laundry load is reduced from 75% (as spun dry by the washing machine) to 4% (dry).

In an embodiment of the present technology, the calculation of the correct amount of ionic substance required may be automated and run on the same micro-controller that is used to control other aspects of dryer management.

In an embodiment of the present technology, in order to assure that the concentration of the ionic substance is constant throughout the entire laundry load, it is introduced as a substance and is well mixed by tumbling the laundry load. The typical moisture content of the 'as spun' laundry load is 50 to 70% water by weight as the load comes from the washer's final spin cycle. A 'dry' laundry load contains between 2 and 4% moisture. Thus, the amount of water contained in the laundry load is reduced by a typical factor of about twenty.

In an embodiment of the present technology, an ionic substance can be added to the object at the timing point selected from the group consisting of: before the drying process starts; at the start of the drying process; and during the drying process.

In an embodiment of the present technology, an ionic substance can be sprayed into the object.

In an embodiment of the present technology, an ionic substance can be embedded into a strip. The strip can be configured to release the ionic substance into the object during the heating process.

In an embodiment of the present technology, wherein the enclosure comprises a dryer drum version of the enclosure having at least one anode element of an arbitrary shape, and at least one cathode area; and wherein the object comprises laundry; and wherein the medium comprises water; and where the ionic substance comprises sodium chloride; an optimum amount of the ionic substance can be introduced into the laundry load during the dry cycle or during the final wash spin cycle in the wash process.

In an embodiment of the present technology, more specifically, the ionic substance can be sprayed near the end of the dry cycle. The laundry load is constantly tumbling which helps the ionic substance to mix evenly throughout the laundry load.

We chose sodium chloride in the above-given example because it is well known to consumers, non-poisonous and readily available. However, as it is disclosed above, many other ionic substances may be safely used. For example, ionic substances such as ammonium chloride or potassium chloride, or even extremely dilute acidic substance of mineral acids such as hydrochloric acid may be used as an ionic adder. However, ionic salts of heavy metals such as cupric sulfate should be avoided due to their toxicity.

In an embodiment of the present technology, the amount of ionic substance introduced into the laundry load can be controlled because it does minimize the RF impedance seen by the RF source. Thus, using a RF impedance sensor immediately following the RF power source provides a means of controlling the amount of ionic substance injected into the laundry load.

Indeed, a RF impedance sensor performs the function of determining when the laundry load is matched ($Rp \rightarrow Rg$ and $Xp \rightarrow 0$). When the RF impedance of the transformed laundry load is minimal (1:1) optimum power transfer from the RF source to the laundry load is achieved.

Monitoring the RF impedance sensor immediately following the RF power source provides a means of adjusting RF matching network elements so that maximum RF power is delivered to the laundry load.

In an embodiment of the present technology, a control loop may be used to automate the RF impedance matching processes. The control loop may be accomplished using either analog or digital means. The digital solution is preferred, as it is relatively easy to adjust the RF matching network element values using an inexpensive digital micro-controller running a simple optimization algorithm. The control loop continuously minimizes load RF impedance seen by the RF power source. When load RF impedance is minimized the load is matched ($Rp \rightarrow Rg$ and $Xp \rightarrow 0$).

In an embodiment of the present technology without a closed loop control system described above, the ionic salt may be introduced: (a) in the washing machine during the machine's spin cycle; (b) in the dryer, prior to commencing the dry cycle; (c) in the dryer, using paper strips treated with a small amount of salt.

The above discussion has set forth the operation of various exemplary systems and devices, as well as various embodiments pertaining to exemplary methods of operating such systems and devices. In various embodiments, one or more steps of a method of implementation are carried out by a processor under the control of computer-readable and computer-executable instructions. Thus, in some embodiments, these methods are implemented via a computer.

In an embodiment, the computer-readable and computer-executable instructions may reside on computer useable/readable media.

Therefore, one or more operations of various embodiments may be controlled or implemented using computer-executable instructions, such as program modules, being executed by a computer. Generally, program modules include routines, programs, objects, components, data structures, etc., that perform particular tasks or implement particular abstract data types. In addition, the present technology may also be practiced in distributed computing environments where tasks are performed by remote processing devices that are linked through a communications network. In a distributed computing environment, program modules may be located in both local and remote computer-storage media including memory-storage devices.

Although specific steps of exemplary methods of implementation are disclosed herein, these steps are examples of steps that may be performed in accordance with various exemplary embodiments. That is, embodiments disclosed herein are well suited to performing various other steps or variations of the steps recited. Moreover, the steps disclosed herein may be performed in an order different than presented, and not all of the steps are necessarily performed in a particular embodiment.

Although various electronic and software based systems are discussed herein, these systems are merely examples of environments that might be utilized, and are not intended to suggest any limitation as to the scope of use or functionality of the present technology. Neither should such systems be interpreted as having any dependency or relation to any one or combination of components or functions illustrated in the disclosed examples.

Although the subject matter has been described in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A method for RF dielectric heating an object immersed in a medium; said method comprising:

(A) placing said object and medium into an enclosure; wherein said object substantially has absorbed said medium in a first "cool" state; and wherein said object includes a maximum weight in said first "cool" state due to absorption of said medium;

(B) adding an ionic substance to at least one of said object and medium;

(C) initiating a heating process by subjecting said object and medium to a variable AC electrical field produced by an RF source; wherein said object is substantially free from said medium in a second "heated" state due to substantial release of said medium from said object; and said released medium is substantially evaporated during said heating process; and (D) controlling said heating process, wherein said heating process is terminated when said object is substantially transitioned into said second "heated" state;

wherein said ionic substance is a substance from the group consisting of a dilute acidic substance of mineral acid; and hydrochloric acid.

2. A method for RF dielectric heating an object immersed in a medium; said method comprising:

(A) placing said object and medium into an enclosure; wherein said object substantially has absorbed said medium in a first "cool" state; and wherein said object includes a maximum weight in said first "cool" state due to absorption of said medium;

(B) adding an ionic substance to at least one of said object and medium;

(C) initiating a heating process by subjecting said object and medium to a variable AC electrical field produced by an RF source; wherein said object is substantially free from said medium in a second "heated" state due to substantial release of said medium from said object; and said released medium is substantially evaporated during said heating process; and (D) controlling said heating process, wherein said heating process is terminated when said object is substantially transitioned into said second "heated" state;

wherein said ionic substance is a substance from the group consisting of HCl; $NH_4OH$; and a mixture of HCl and $NH_4OH$.

* * * * *